US005090838A

United States Patent [19]

Baldino et al.

[11] Patent Number: 5,090,838

[45] Date of Patent: Feb. 25, 1992

[54] MODULAR ROOF PANEL ASSEMBLY AND LOCKING APPARATUS FOR A MODULAR PANEL SYSTEM USED IN CONSTRUCTING RELOCATABLE BUILDINGS

[75] Inventors: Michael Baldino, Omaha; Daniel L. Kelsay, Fremont, both of Nebr.

[73] Assignee: Kelly Industries, Fremont, Nebr.

[21] Appl. No.: 688,028

[22] Filed: Apr. 19, 1991

Related U.S. Application Data

[62] Division of Ser. No. 415,007, Sep. 29, 1989.

[51] Int. Cl.[5] ..... B25G 3/36

[52] U.S. Cl. ..... 403/388; 403/408.1

[58] Field of Search ..... 403/408.1, 154, 388; 411/553, 552, 549, 349

[56] References Cited

U.S. PATENT DOCUMENTS

| | | | |
|---|---|---|---|
| 835,966 | 11/1906 | Lyster . | |
| 1,840,041 | 1/1932 | Kellogg . | |
| 2,332,752 | 10/1943 | Ratcliff | 403/388 |
| 2,588,951 | 3/1952 | Anstett | 411/349 X |
| 2,611,454 | 9/1952 | Arehart et al. | 189/2 |
| 2,953,836 | 9/1960 | Crook | 403/408.1 X |
| 3,555,754 | 1/1971 | Kellogg | 52/282 |
| 4,453,356 | 6/1984 | Kellogg et al. | 52/293 |
| 4,657,462 | 4/1987 | Hoen | 411/552 |

FOREIGN PATENT DOCUMENTS

| | | |
|---|---|---|
| 475039 | 2/1976 | Australia . |
| 564880 | 10/1958 | Canada . |
| 2844615 | 11/1979 | Fed. Rep. of Germany . |

*Primary Examiner*—Andrew V. Kundrat

*Attorney, Agent, or Firm*—Panitch Schwarze Jacobs & Nadel

[57] ABSTRACT

A modular roof panel assembly for a modular panel system used in constructing relocatable buildings. The roof panel assembly includes a first panel hingedly connected to a second panel for allowing the first and second panels to pivot towards and away from each other about a common axis. The first panel is hingedly connected to the second panel such that a plurality of apertures exist between the first and second panels proximate the common axis and for allowing the panels to be folded to a compact configuration to decrease shipping, handling and storing costs. The assembly includes a ridge cap for preventing water from passing through the apertures between the first and second panels. The ridge cap includes a top panel sized to cover the apertures and is positioned above the first and second panels proximate the apertures. A corresponding plurality of securing tabs integral with the top panel and extending downwardly therefrom extend through the apertures to secure the top panel to the first and second panels. The securing tabs are bent upwardly into engagement with one of the panels to thereby secure the top panel to the first and second panels.

3 Claims, 4 Drawing Sheets

MODULAR ROOF PANEL ASSEMBLY AND LOCKING APPARATUS FOR A MODULAR PANEL SYSTEM USED IN CONSTRUCTING RELOCATABLE BUILDINGS

This is a division of application Ser. No. 07/415,007, filed Sept. 29, 1989.

FIELD OF THE INVENTION

The present invention relates to relocatable building structures of the modular panel type and, more particularly, to a ridge cap for a modular roof panel assembly having an apex with apertures therein and an apparatus for lockably securing modular panels together.

BACKGROUND OF THE INVENTION

In the modular panel relocatable building field, there exists a need for a modular roof panel assembly which is flexible or adaptable to a plurality of widths or angles while, at the same time, remaining water tight. More particularly, there exists a need to provide a modular roof panel assembly having an apex with apertures therein with a ridge cap for preventing water or fluid from passing through the apertures in the apex without sacrificing the pitch requirements for drainage. Furthermore, there is a need for a ridge cap which can be quickly connected to the modular roof panel assembly to facilitate and reduce the time necessary and utilities used (e.g., tools and power equipment) to assemble the relocatable building structure. There further exists a need for a modular roof panel assembly which is foldable to a compact configuration to decrease shipping, handling and storing costs.

Water tight relocatable building structures of the modular panel type are known. Conventionally, each modular panel is rectangular and includes a rigid frame formed by three steel angles and a channel member or formed of four angles above. Secured to the frame of each panel is a ribbed steel sheet which, along with the frame, provides strength characteristics which eliminate the need for special structural members when large buildings are erected. The sheet of each panel includes a projecting rib that overlaps with the first rib of the adjacent panel so that water tight joints are provided when the panels are bolted together and assembled during erection of the building.

However, such water tight relocatable building structures do not address the need of preventing leakage through the peak, ridge or apex of the modular roof panel assembly. Normally, the adjacent roof panels on opposite sides of the peak of the roof are connected at the ridge or apex by a channel shaped connector which is bolted or keyed as discussed hereinafter to the angle members on the ends of the panels. Then a "V" shaped ridge cap is attached to the panels with self-taping screws. This procedure is time consuming in that it requires workers to physically bolt the channel shaped connector and ridge cap to the roof and then provide a sealant between the ridge cap and panel for preventing fluid from passing therebetween. This procedure requires skilled workers and often takes a considerable amount of time which is contrary to the intentions of a relocatable building structure, which preferably is quickly set up or taken down. This procedure further requires the use of power driven tools, which may not be readily available in certain field locations.

In the conventional modular panel systems, each modular panel has apertures in the angle members of the frame, such that when the modular panels are in engagement the apertures are in registry. A key member is positioned within the apertures for connecting the modular panels together. Typically, the key member is rotated between a first position wherein the panels are not secured together and a second position wherein the panels are secured together. Consequently, the conventional modular panel systems can be quickly set up or taken down through the use of these rotating key members.

While the key members sufficiently secure the panels together, they are problematic in that they cannot be locked in the second position when the panels are secured together. Consequently, there exists a need for locking the key members in the second position to prevent the key members from accidentally being bumped into the first position. Moreover, locking the key members in the second position helps prevent vandalism, and also prevents the key members from loosening due to vibration which adversely affects the structural integrity of the building.

The present invention provides a modular roof panel assembly which includes a ridge cap which can be quickly connected to the apex of the modular roof panel assembly. The apex includes apertures for receiving a portion of the ridge cap therethrough to quickly connect the ridge cap to the modular roof panel assembly. In the present invention, the modular roof panel assembly is flexible or adaptable to a plurality of widths or angles while, at the same time, remains water tight. The present invention is compact for shipping, handling and storing purposes and yet is simple to assemble for allowing unskilled workers to perform the assembled process. Also, the present invention provides means for locking a key member for a modular panel system in the second position for preventing the modular panels from being disassembled. Consequently, use of the present invention results in considerable savings in money as well as time for installation and removal and provides added safety to the structural integrity of the modular panel relocatable building.

SUMMARY OF THE INVENTION

Briefly stated, the present invention comprises a modular roof panel assembly for a modular panel system used in constructing relocatable buildings. The roof panel assembly includes a first panel hingedly connected to a second panel for allowing the first and second panels to pivot towards and away from each other about a common axis. The first panel is hingedly connected to the second panel such that an aperture exists between the first and second panels proximate the common axis. A ridge cap is provided for preventing water from passing through the aperture between the first and second panels. The ridge cap includes a top panel sized to cover the aperture and is positioned above the first and second panels proximate the aperture. A securing tab is integral with the top panel and engaged with the one of the first or second panels for securing the top panel to the first and second panels. Thus, the ridge cap is securely positioned on the first and second panels over the aperture therebetween to prevent water from passing therethrough.

A further aspect of the present invention comprises an apparatus for lockably securing a first elongated member to a second elongated member. The members each include at least a first or vertical portion and a second or horizontal portion. The vertical portion of each member includes at least one aperture extending completely therethrough. The first portion of the first member is in engagement with the first portion of the second member such that the apertures are in registry. The apparatus comprises a key member including a head portion for being positioned within the apertures for connecting the first and second members together. The key member is rotated between a first position wherein the first and second members are not secured together and a second position wherein the first and second members are secured together. Locking means is provided for locking the key member in the second position whereby the first and second members are lockably secured together.

BRIEF DESCRIPTION OF THE DRAWINGS

The foregoing summary, as well as the following detailed description of the preferred embodiments, is better understood when read in conjunction with the appended drawings. For the purpose or illustrating the invention, there is shown in the drawings embodiments which are presently preferred, it being understood, however, that the invention is not limited to the specific methods and instrumentalities disclosed. In the drawings.

DESCRIPTION OF THE PREFERRED EMBODIMENT

Figure 1:
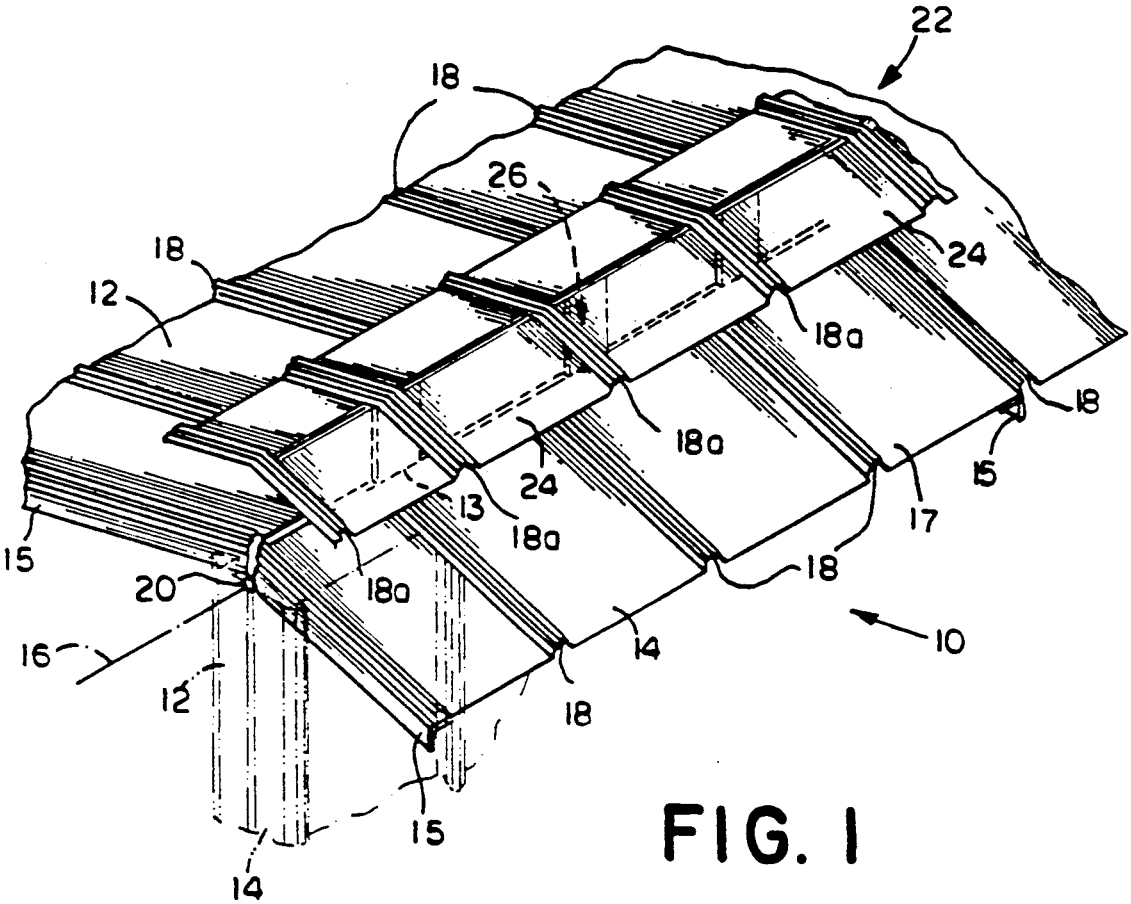
FIG. 1 is an exploded perspective view partially in phantom of a portion of the modular roof panel assembly in accordance with a first preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the modular roof panel assembly and locking apparatus and designated parts thereof. The terminology includes the words above specifically mentioned, derivatives thereof and words of similar import.

Referring to the drawings in detail, wherein like numerals indicate like elements throughout, there is shown in FIGS. 1–4 a first preferred embodiment of a modular roof panel assembly in accordance with the present invention. FIG. 1 perspectively illustrates the modular roof panel assembly 10 in an unassembled form.

Referring now to FIG. 1, the modular roof panel assembly 10 includes a first panel 12 hingedly connected to a second panel 14 for allowing the first and second panels 12, 14 to pivot towards and away from each other about a common axis 16. The first and second panels 12, 14 pivot between a first position, shown in phantom in FIG. 1, wherein the first and second panels 12, 14 are in a juxtaposed parallel relationship and a second position, wherein the first and second panels 12, 14 lie in the same plane (not shown). The modular roof panel assembly 10 is preferably shipped, stored and handled in the first position due to the compact size of the modular roof panel assembly 10. Since the first and second panels 12, 14 are pivotally connected, the first and second panels 12, 14 can be positioned at any angle between the first and second positions with respect to each other to facilitate handling and assembly of the relocatable building. Thus, the modular roof panel assembly 10 of the present invention can accommodate room or building dimensions of varying size.

In the present embodiment, the first and second panels 12, 14 are preferably constructed substantially as shown and described in U.S. Pat. No 4,453,356, which is hereby incorporated by reference. That is, the panels 12 and 14 are preferably constructed of a high strength metallic material, such as galvanized steel. However, it is understood by those skilled in the art that the panels 12 and 14 can be constructed of other materials, such as fiberglass or aluminum. Preferably, the panels 12 and 14 each comprise a frame 15 and a sheet of material 17, such as steel, secured thereto, as disclosed in U.S. Pat. No. 4,453,356. Further, it is preferred that each panel include ribs 18 on the outwardly facing side of the panel and corresponding grooves on the inwardly facing side of the panel. As described in U.S. Pat. No. 4,453,356, the ribs 18 allow for a water tight connection between the modular panels.

In the first preferred embodiment, the first panel 12 is hingedly connected to the second panel 14 such that at least one aperture 13 exists between the first and second panels 12 and 14 proximate the common axis 16. More particularly, it is preferred that a plurality of hinges 20 be interconnected between the first and second panels 12 and 14 for allowing the panels 12 and 14 to pivot with respect to each other. That is, the hinges 20 are interspersed along the apex of the modular roof panel assembly 10, such that at least one aperture 13 exists between the first and second panels 12, 14. Specifically, the hinges 20 are interspersed along the apex of the modular roof panel assembly 10 such that a plurality of apertures 13 are spaced along the apex, each aperture 13 being positioned between a pair of hinges 20.

In the first preferred embodiment, the hinges 20 are preferably standard pin hinges which are typically used to hingedly connect a door to a frame. Preferably, the hinges 20 are welded (not shown) to the first and second panels 12, 14 before the modular roof panel assembly is shipped to a building site. However, it is understood by those skilled in the art, that other methods and instrumentalities can be used to hingedly connect the first and second panels 12, 14, such as standard bolts and nuts or self-tapping screws. Moreover, the first and second panels 12, 14 could include cooperating members (not shown) integral therewith which allow the panels 12, 14 to pivot with respect to each other.

As shown in FIG. 1, the modular roof panel assembly 10 includes a ridge cap 22 for preventing water from passing through the apertures 13 between the first and second panels 12, 14. The ridge cap 22 includes a top panel 24 sized to cover each aperture 13. The ridge cap 22 is preferably positioned above the first and second panels 12, 14 proximate the apertures 13.

Figure 3:
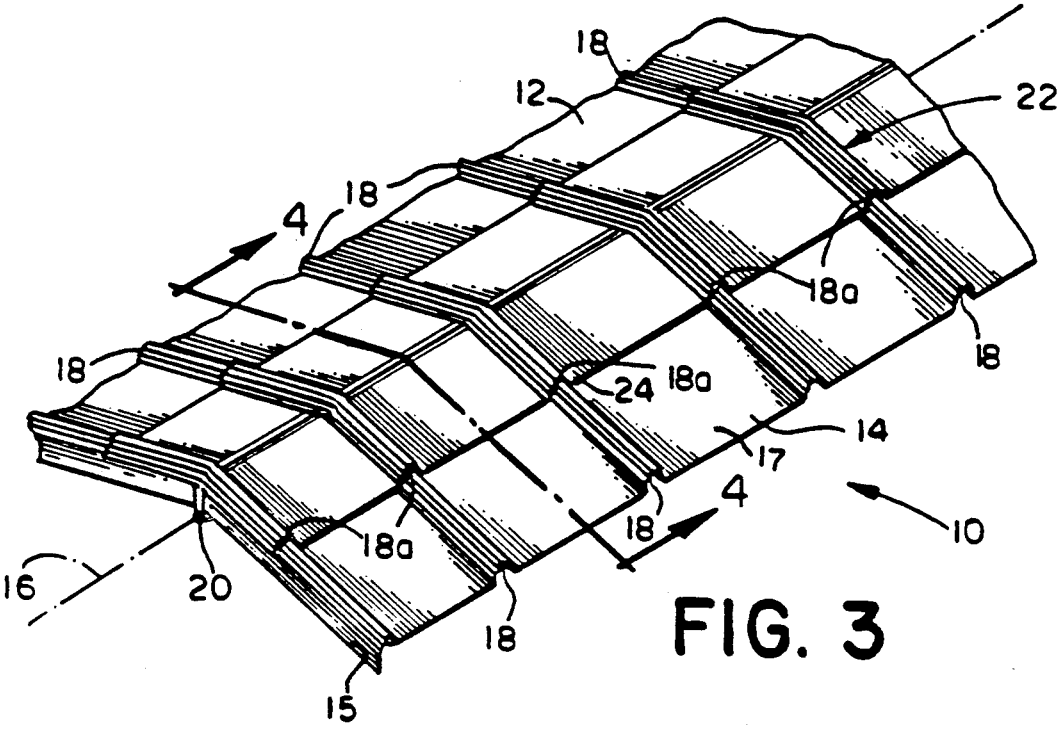
FIG. 3 is a perspective view of a portion of the modular roof panel assembly in accordance with the first preferred embodiment of the present invention.

In the present embodiment, it is preferred that the top panel 24 be generally "V" shaped to complement and engage the first and second panels 12, 14. Preferably the top panel 24 is constructed of a sheet of flexible material for allowing the top panel 24 to conform or correspond to the angular position of the first and second panels 12, 14, as shown in FIG. 3. In the first preferred embodiment, the top panel 24 is constructed of high strength metallic material, such as steel. However, it is understood by those skilled in the art that the top panel 24 can be constructed of a polymeric or other suitable material without departing from the spirit and scope of the invention.

Sealing means (not shown) is provided between the top panel 24 and the sheet of material 17 to prevent fluid from passing therebetween, for instance during a hard driving rainstorm. Preferably, the sealing means comprises weather stripping (not shown) adhesively attached to the outer edges of the ridge cap 22. However, it is understood by those skilled in the art, that other means could be used to seal the ridge cap, such as caulk or a silicone compound.

As shown in FIG. 3, the top panel 24 includes ribs 18*a* which correspond and complement the ribs 18 in the first and second panels 12, 14. By interlocking the ribs 18 and 18*a* as shown in FIG. 3, the top panel 24 is prevented from moving with respect to the first and second panels 12, 14 along the common axis 16, to help secure the ridge cap 22 to the first and second panels 12, 14.

Figure 2:
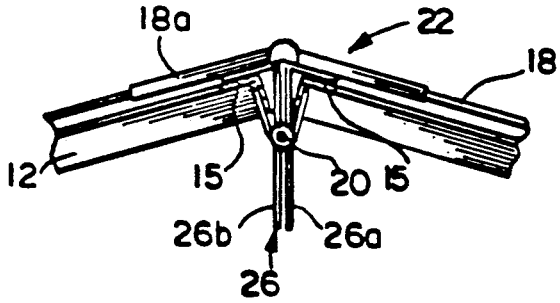
FIG. 2 is a partial cross-sectional view of a partially assembled modular roof panel assembly in accordance with the first preferred embodiment of the present invention.

As shown in FIGS. 1 and 2, the ridge cap 22 includes securing means integral with the top panel 24 and engaged with one of the first or second panels 12, 14 for securing the top panel 24 to the first and second panels 12, 14. Preferably, the securing means extends through the aperture 13 between the first and second panels 12, 14. The securing means for attaching the top panel 24 to the first and second panels 12, 14 in the first preferred embodiment preferably comprises a securing tab, generally designated 26, integral with the top panel 24 and extending downwardly therefrom through one of the apertures 13 between the first and second panels 12, 14.

As used herein, the term "integral" is defined as any means for fixing the securing tab 26 to the top panel 24. For instance, the securing tab 26 could be fixed to the top panel 24 by any suitable method, including welding, riveting, screws or epoxy. In the second preferred embodiment, the securing tab 26 is preferably welded to the top panel 24, as is understood by those skilled in the art.

More particularly, as shown in FIG. 2, it is preferred that the securing tab 26 be comprised of two generally identical parallel sheets 26*a* and 26*b* of high strength-flexible or malleable material, such as steel. However, it is understood by those skilled in the art, that the securing tab 26 can be constructed of other malleable high strength materials, such as aluminum. It is also understood by those skilled in the art, that a single securing tab 26 can be used instead of two securing tabs to secure the top panel 24 to the first and second panels 12 and 14, without departing from the spirit and scope of the invention.

Figure 4:
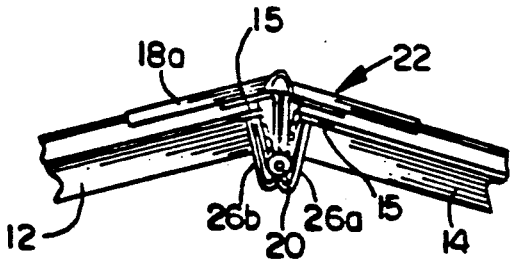
FIG. 4 is a partial cross-sectional view of the modular roof panel assembly of FIG. 3 taken along line 4—4 of FIG. 3.

Referring now to FIG. 4, after the securing tab 26 is positioned through the aperture 13, it is bent upwardly into engagement with one of the panels 12, 14 to thereby secure the top panel 24 to the first and second panels 12, 14. More particularly, it is preferred that the parallel sheets 26*a* and 26*b* be bent upwardly in opposite directions into engagement with the frame 15 of the panels 12, 14.

While the above description has generally been directed to a single aperture 13 and securing tab 26, it is understood by those skilled in the art, that the first and second panels 12, 14 preferably include a plurality of apertures 13 therebetween. Similarly, the securing means preferably comprises a corresponding plurality of securing tabs 26 integral with the top panel 24 and extending therefrom through the apertures 13 for securing the top panel 24 to the first and second panels 12, 14.

Referring now to FIG. 2, to position the ridge cap 22 on the first and second panels 12, 14, the first and second panels 12, 14 are positioned at the desired relative apex angle and secured to the relocatable building structure (not shown) in a manner known to those skilled in the art. The ridge cap 22 is then positioned over or above the apex with top panel 24 in complementary sealed engagement with the first and second panels 12, 14 and the securing tabs 26 extending downwardly through the apertures 13 between the first and second panels 12, 14, as shown in FIG. 2.

As shown in FIG. 4, to secure the ridge cap 22 to the first and second panels 12, 14, the parallel sheets 26*a* and 26*b* are bent upwardly in opposite directions into engagement with each panel 12, 14. That is, the parallel sheets 26*a* and 26*b* are bent around the frame 15 into engagement therewith, such that the sheets 26*a* and 26*b* are generally "J" shaped in cross section. This effectively secures the ridge cap 22 to the first and second panels 12, 14, such that even during harsh weather and heavy winds, the ridge cap 22 remains secured to the panels 12, 14.

To remove the ridge cap 22 from the panels 12, 14, the sheets 26*a* and 26*b* are rebent to the original parallel form as shown in FIG. 2 and the ridge cap is simply lifted from the first and second panels 12, 14.

Figure 5:
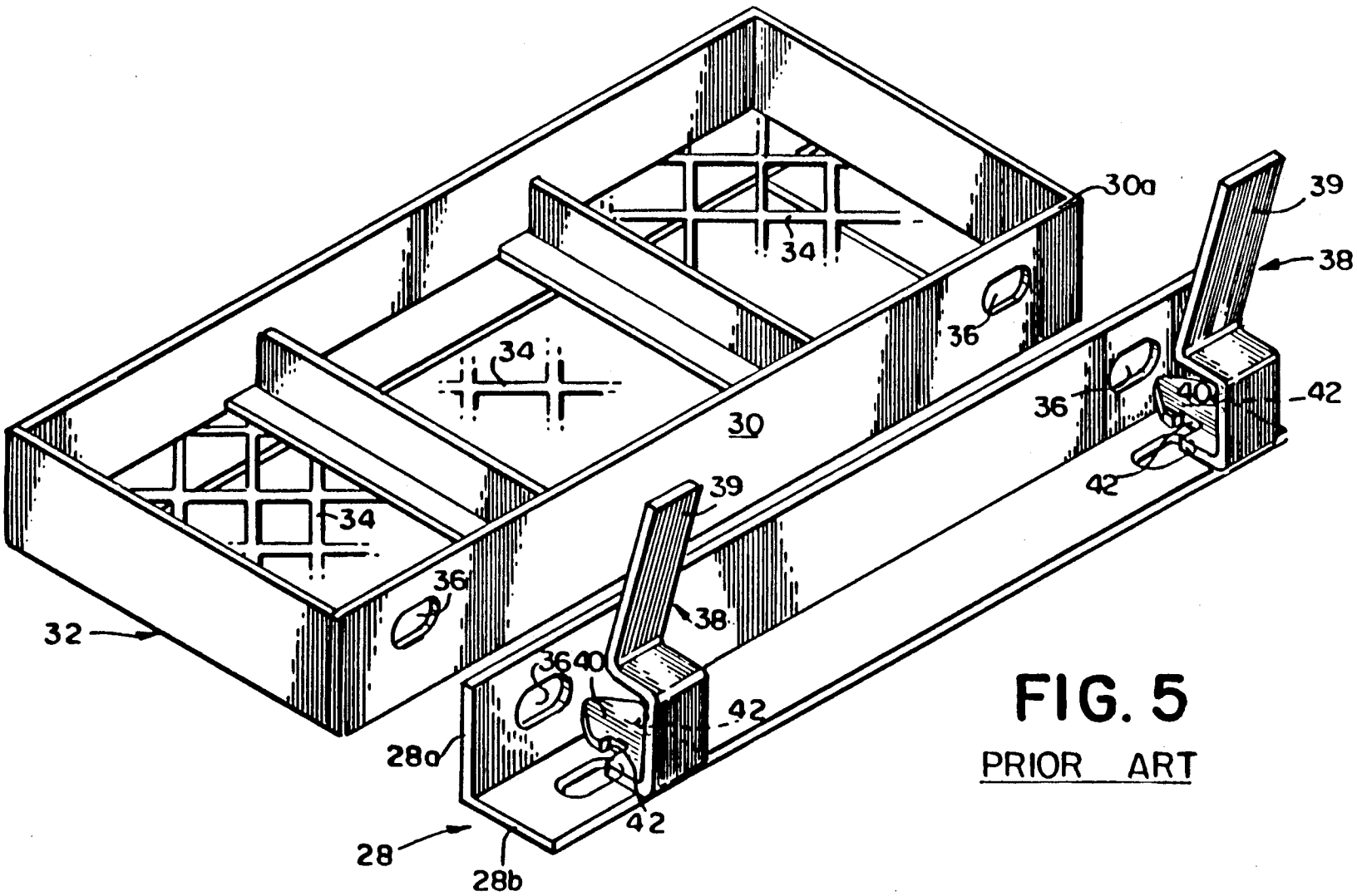
FIG. 5 PRIOR ART
FIG. 5 is an exploded perspective view of a conventional key member for lockably connecting a first member to a second member.
Figure 6:
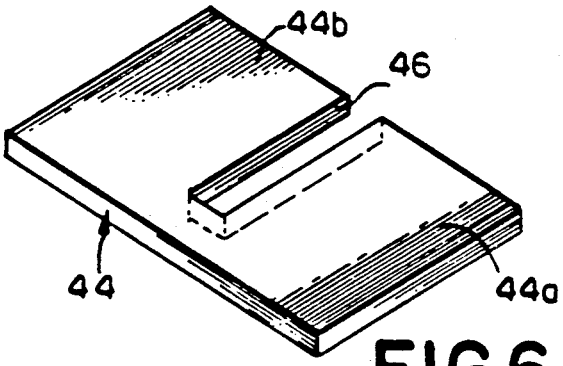
FIG. 6 is a perspective view of a locking apparatus in accordance with a second preferred embodiment of the present invention.
Figure 7:
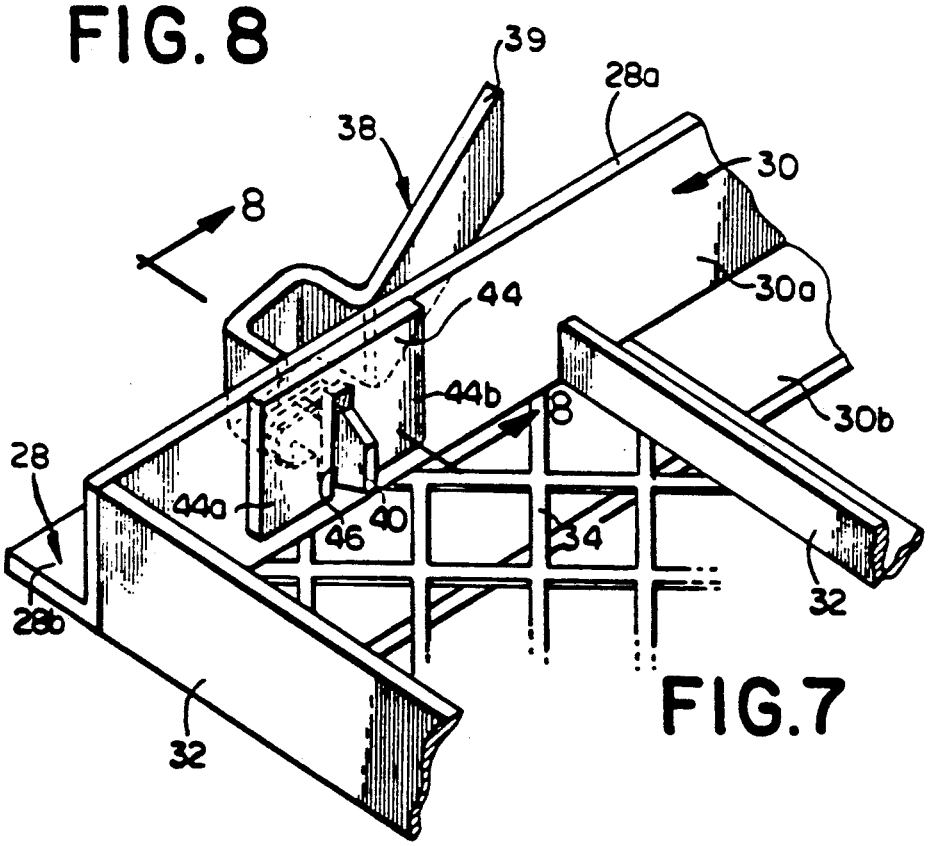
FIG. 7 is a perspective view of the key member and locking apparatus for securably locking the members together in accordance with the second preferred embodiment of the invention.

Referring now to FIGS. 5–8, there is shown an apparatus for lockably securing a first elongated member 28 to a second elongated member 30, in accordance with a second preferred embodiment of the present invention. As shown in FIGS. 5 and 7, the first elongated member 28 and the second elongated member 30 each include at least a first or vertical portion 28*a*, 30*a* and a second or horizontal portion 28*b* and 30*b*, respectively. The first and second members 28, 30 are preferably L-shaped in cross section, as shown in FIG. 5. However, it is understood by those skilled in the art that the first and second elongated members 28 and 30 could be configured in other similar shapes, such as U or V-shaped.

Referring now to FIG. 5, the first and second elongated members 28 and 30 are preferably used to construct a frame 32 for receiving a sheet of material (not shown) or lattice structure 34. That is, the first and second elongated members 28 and 30 are preferably used to construct the frame 32 of a panel member used for constructing a relocatable building structure as described above and in U.S. Pat. No. 4,453,536 or in U.S. Pat. No. 3,555,784, which is hereby incorporated by reference.

In the second preferred embodiment, the frame 32 and first and second elongated members 28 and 30 are preferably constructed of a metallic material, such as steel. However, it is understood by those skilled in the art, that other high strength metallic alloys or composite materials can be used to construct the frame 32 and/or first and second elongated members 28, 30, such as aluminum or fiberglass. Similarly, the sheet of material or lattice structure 34 is preferably constructed of the same material as the frame 32. However, it is understood by those skilled in the art, that different materials can be used to construct the sheet of material or lattice structure 34, such as a polymeric or other suitable material. Furthermore, it is also understood that the sheet of material could be constructed of a translucent polymeric material.

As shown in FIG. 5, the vertical portions 28*a* and 30*a* of the first and second elongated members 28, 30 each include at least one aperture 36 extending completely therethrough. In the second preferred embodiment, the apertures 36 are preferably generally oval-shaped. However, it is understood by the ordinarily skilled artisan that the apertures 36 could be configured in other shapes, such as rectangular or elliptical.

Figure 8:
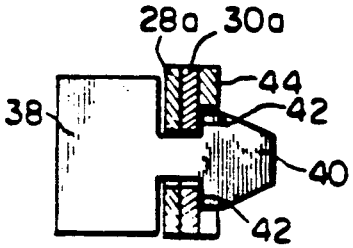
FIG. 8 is a cross-sectional view of the key member and locking apparatus of FIG. 7 taken along line 8—8 of FIG. 7.

To lockably secure the first elongated member 28 to the second elongated member 30, the vertical portion 28*a* of the first member 28 is placed in facing engagement with the vertical portion 30*a* of the second member 30, such that the apertures 36 are in registry, as shown in FIGS. 7 and 8.

Referring now to FIG. 5, a key member 38 is provided for connecting the first and second members 28, 30 together. The key member 38 is provided with a handle portion 39 which allows the key member 38 to be readily gripped for rotation of the key member 38, as described hereinafter. A more detailed description of the key member 38 is disclosed in U.S. Pat. No. 3,555,754.

The key member 38 further includes a head portion 40 for being positioned within the apertures 36 to connect the first and second members together. As shown in FIGS. 5 and 8, the head portion 40 includes notch means therein. In the second preferred embodiment, the notch means preferably comprises a pair of opposing notches 42 correspondingly sized to complement the width of both the first member vertical portion 28*a* and the second member vertical portion 30*a*, together. However, it is understood by those skilled in the art, that the notch means could comprise a single notch for receiving the vertical portions 28*a* and 30*a*, without departing from the spirit and scope of the invention.

As shown in FIG. 7, the vertical portions 28*a*, 30*a* of the first and second members 28, 30 are positioned in facing engagement with the apertures 36 in registry for receiving the head portion 40 of the key member 38 therein. With the head portion 40 within the apertures 36, the key member 38 is rotated between a first position having an orientation as depicted in FIG. 5 wherein the first and second members 28, 30 are not secured together and a second position (see FIG. 7) wherein the first and second members 28, 30 are secured together, as described in more detail hereinafter.

Referring now to FIG. 5, the key member 38 is generally shown in the first position, however, the key member is not positioned within the apertures 36. More particularly, when the key member 38 is in the first position, the head portion 40 is positioned within the apertures 36, except, the vertical portions 28*a* and 30*a* are not positioned within the opposing notches 42. When the key member 38 is rotated to the second position (as shown in FIG. 7) the first and second members 28, 30 are secured together because the vertical portions 28*a* and 30*a* are positioned within the opposing notches 42.

Referring now to FIGS. 6–8, there is shown a locking apparatus or locking means for locking the key member 38 in the second position whereby the first and second members 28, 30 are lockably secured together. In the second preferred embodiment, the locking means preferably comprises a generally rigid member 44 having notch means therein. Preferably, the rigid member 44 is comprised of a generally rectangular slug-like member. However, it is understood by those skilled in the art, that the rigid member 44 can be configured in other similar shapes, such as trapezoidal or square.

Preferably, the notch means comprises a generally elongated notch 46 extending inwardly from one side of the rigid member. Preferably, the notch 46 is sized to frictionally complement the head portion 40 of the key member 38 to prevent the rigid member 44 from readily separating from the head portion 40. However, it is understood by those skilled in the art that the notch 46 could be configured in other shapes. For instance, the notch 46 could be configured in the form of an aperture-like slot (not shown) centrally disposed within the rigid member 44.

As shown in FIGS. 7 and 8, the head portion 40 is positioned within the notch 46 when the key member 38 is in the second position, such that when rotation of the key member 38 is attempted, one of the depending legs 44*a* or 44*b* (depending upon the rotational direction) of the rigid member 44 engages the second member 30 to prevent the rotation of the rigid member 44 and the key member 38 with respect to the first and second members 28 and 30, to thereby securely lock the key member 38 in the second position.

It is understood by those skilled in the art, that the key member 38 can be positioned with respect to the first and second members 28, 30, such that the head portion 40 extends away from either the first member vertical portion 28*a* (not shown) or the second member vertical portion 30*a* (as shown in FIG. 7). For instance, when the head portion 40 is positioned such that it extends away from the first member vertical portion 28*a*, the rigid member 44 is preferably positioned in facing engagement with the first member vertical portion 28*a*, such that the head portion 40 extends through the notch 46 in the rigid member 44. Therefore, when the key member 38 is rotated the rigid member 44 engages the first member horizontal portion 28*b* to prevent the key member 38 from rotating.

While in the second preferred embodiment, the rigid member 44 is preferably positioned with the head portion 40 extending through the notch 46, it is understood by those skilled in the art that the rigid member 44 can be positioned in facing engagement on either side of the first or second member vertical portion 28*a*, 30*a* to prevent the key member 38 from being rotated regardless of which side the handle 39 is positioned on, without departing from the spirit and scope of the invention.

Figure 9:
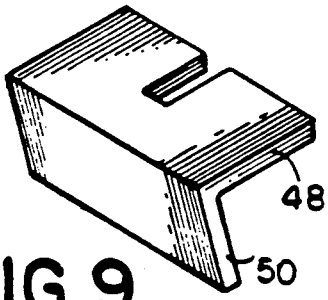
FIG. 9 is a perspective view of a locking apparatus in accordance with a third preferred embodiment of the present invention.

Referring now to FIG. 9, there is shown a generally L-shaped rigid member 48 in accordance with a third preferred embodiment of the invention. The L-shaped rigid member 48 is generally identical to the rigid member 44 described above, but includes a perpendicularly extending leg 50 for engagement with one of the first or second members vertical portions 28*a* or 30*a*. That is, the rigid member 48 is positioned over the head portion 40 of the key member 38 in a generally identical manner as that described above, except when an attempt is made to rotate the key member 38 from the second position to the first position, the perpendicularly extending leg 50 engages one of first or second members vertical portions 28*a* or 30*a* (not shown) to thereby prevent the key member 38 from rotating.

While the above description is generally directed to the use of a single key member 38 and rigid member 44, it is understood by those skilled in the art that the first and second members vertical portions 28*a* and 30*a* include a plurality of apertures 36 in registry and a corresponding number of key members 38 and rigid members 44. Consequently, the above description of a single key member 38 and rigid member 44 is for convenience only and is not limiting.

From the foregoing description, it can be seen that the present invention comprises a modular roof panel assembly and locking apparatus for a modular panel system used in constructing relocatable buildings. It is recognized by those skilled in the art that changes may be made to the above-described embodiments of the invention without departing from the broad inventive concepts thereof. It is understood, therefore, that this invention is not limited to the particular embodiments disclosed but is intended to cover all modifications which are within the scope and spirit of the invention as defined by the appended claims.

We claim:

1. An apparatus for lockably securing a first elongated member to a second elongated member, said members each including at least a first portion and a second portion, said first portion of each member including at least one aperture therethrough, said first portion of said first member being in engagement with said first portion of said second member such that said apertures are in registry, said apparatus comprising:

a key member including a head portion for being positioned within said apertures for connecting said first and second members together, said key member being rotated between a first position wherein said first and second members are not secured together and a second position wherein said first and second members are secured together; and locking means for locking said key member in said second position whereby said first and second members are lockably secured together, said locking means comprising a separate generally rigid member having notch means therein, said head portion being positioned within said notch means when said key member is in said second position such that when said key member is rotated said rigid member engages one of said first or second members to prevent the rotation of said rigid member and said key member with respect to said first and second members to thereby securely lock said key member in said second position.

2. The apparatus as recited in claim 1, wherein when said key member is rotated said rigid member engages one of said first or second members second portion.

3. The apparatus as recited in claim 1 wherein when said key member is rotated said rigid member engages one of said first or second members first portion.

* * * * *